US009280105B2

(12) United States Patent
Ryu et al.

(10) Patent No.: US 9,280,105 B2
(45) Date of Patent: Mar. 8, 2016

(54) FIXING DEVICE AND IMAGE FORMING APPARATUS

(75) Inventors: Takayuki Ryu, Kanagawa (JP); Yasutaka Gotoh, Kanagawa (JP); Koji Okabe, Kanagawa (JP); Yuki Kubota, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 103 days.

(21) Appl. No.: 13/592,715

(22) Filed: Aug. 23, 2012

(65) Prior Publication Data

US 2013/0259544 A1 Oct. 3, 2013

(30) Foreign Application Priority Data

Mar. 27, 2012 (JP) ..... 2012-071039

(51) Int. Cl.
*G03G 15/20* (2006.01)

(52) U.S. Cl.
CPC ..... *G03G 15/2053* (2013.01); *G03G 15/206* (2013.01); *G03G 2215/0132* (2013.01); *G03G 2215/2009* (2013.01); *G03G 2215/2035* (2013.01)

(58) Field of Classification Search
CPC ..... G03G 2215/2058; G03G 15/2053; G03G 15/2017; G03G 15/2032; G03G 15/6067
USPC ..... 399/122, 320, 328, 330, 331
See application file for complete search history.

(56) References Cited

U.S. PATENT DOCUMENTS

| | | | | |
|---|---|---|---|---|
| 6,035,174 | A * | 3/2000 | Ito et al. | 399/328 |
| 2005/0180789 | A1* | 8/2005 | Nakamura et al. | 399/330 |
| 2008/0152410 | A1* | 6/2008 | Fukuda et al. | 399/409 |
| 2008/0187373 | A1* | 8/2008 | Tsueda et al. | 399/330 |
| 2009/0022528 | A1* | 1/2009 | Matsuno et al. | 399/330 |
| 2010/0183348 | A1* | 7/2010 | Law et al. | 399/333 |
| 2011/0044738 | A1* | 2/2011 | Duda et al. | 399/333 |

FOREIGN PATENT DOCUMENTS

JP 2003-048655 A 2/2003

* cited by examiner

*Primary Examiner* — Benjamin Schmitt
*Assistant Examiner* — Matthew Miller
(74) *Attorney, Agent, or Firm* — Sughrue Mion, PLLC

(57) ABSTRACT

A fixing device includes a pressing member that is rotatably held and provides a pressure acting in one direction; a heating member that is rotatably held, faces the pressing member, and includes a substantially cylindrical member and a heating unit, the substantially cylindrical member receiving the pressure, the heating unit being provided inside the substantially cylindrical member, the heating member fixing a toner image on a sheet with the pressure and heat; a drive source that outputs a driving force with which the heating member is rotated; and a transmission member having a space that receives an end of the substantially cylindrical member with a gap interposed therebetween, the transmission member having an inner circumferential surface that comes into contact with the end of the substantially cylindrical member in the space when the substantially cylindrical member receives the pressure, the transmission member transmitting the driving force to the heating member.

6 Claims, 16 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-071039 filed Mar. 27, 2012.

BACKGROUND

Technical Field

The present invention relates to a fixing device and an image forming apparatus.

SUMMARY

According to an aspect of the invention, there is provided a fixing device including a pressing member that is rotatably held and provides a pressure acting in one direction; a heating member that is rotatably held in such a manner as to face the pressing member and includes a substantially cylindrical member and a heating unit, the substantially cylindrical member receiving the pressure, the heating unit being provided inside the substantially cylindrical member, the heating member fixing a toner image on a sheet with the pressure provided by the pressing member and heat generated by the heating unit; a drive source that outputs a driving force with which the heating member is rotated; and a transmission member that provides a space that receives an end of the substantially cylindrical member with a gap interposed therebetween, the transmission member having an inner circumferential surface that comes into contact with the end of the substantially cylindrical member in the space when the substantially cylindrical member receives the pressure from the pressing member, the transmission member transmitting the driving force of the drive source to the heating member.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the accompanying drawings.

Figure 1:
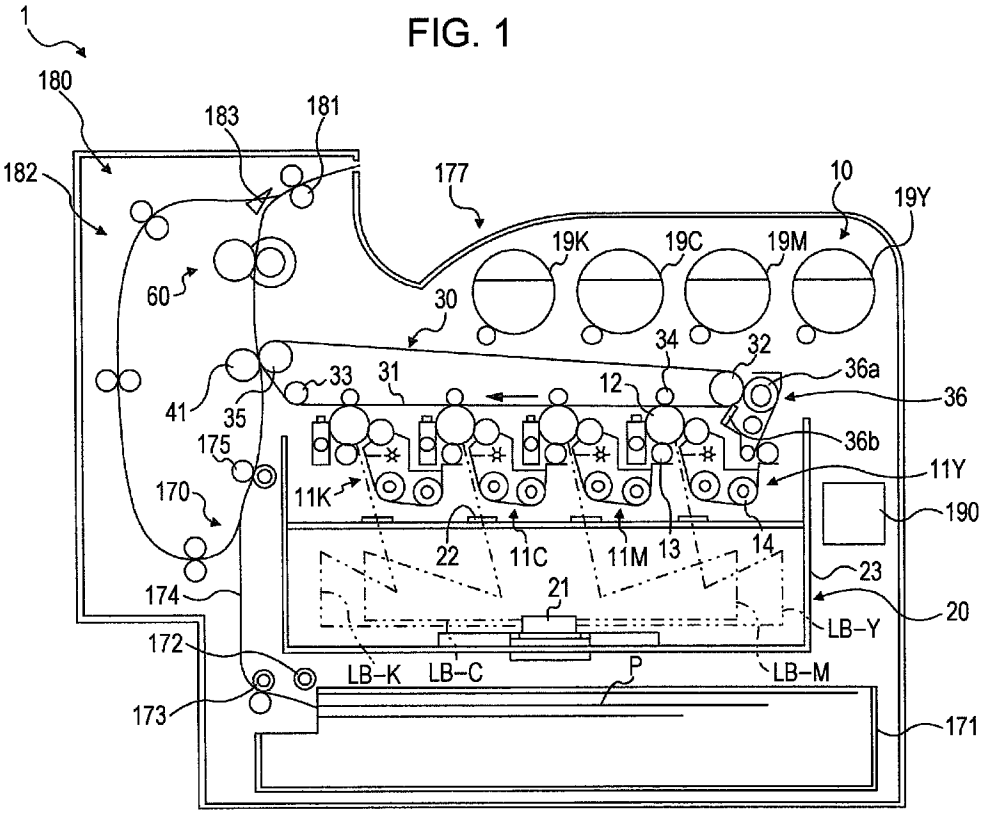
FIG. 1 schematically illustrates an image forming apparatus according to a general exemplary embodiment of the present invention.

FIG. 1 schematically illustrates an image forming apparatus 1 according to a general exemplary embodiment of the present invention.

The image forming apparatus 1 includes an image forming section 10 that forms an image on a recording material (hereinafter referred to as "sheet P", specifically), a sheet feeding section 170 that feeds a sheet P to the image forming section 10, a stacking portion 177 on which the sheet P having an image formed thereon by the image forming section 10 is stacked, a sheet transport section 180 that transports the sheet P having an image formed thereon by the image forming section 10, and a controller 190 that controls operations of the foregoing sections.

The image forming section 10 includes four image forming units 11Y, 11M, 11C, and 11K for different colors of yellow (Y), magenta (M), cyan (C), and black (K) that are provided in parallel at substantially constant intervals. The image forming units 11 each include a photoconductor drum 12, a charging device 13 that uniformly charges the surface of the photoconductor drum 12, and a development device 14 that develops and visualizes an electrostatic latent image formed with a laser beam emitted by an optical unit 20, to be described below, into a toner image with a predetermined color toner. The image forming section 10 further includes toner cartridges 19Y, 19M, 19C, and 19K from which toners having the different colors are supplied to the development devices 14 of the image forming units 11Y, 11M, 11C, and 11K, respectively. The optical unit 20 is provided below the image forming units 11Y, 11M, 11C, and 11K and applies laser beams LB-Y, LB-M, LB-C, and LB-K to the photoconductor drums 12 of the image forming units 11Y, 11M, 11C, and 11K, respectively.

The image forming section 10 further includes an intermediate transfer unit 30 in which the toner images in the different colors formed on the respective photoconductor drums 12 of the image forming units 11Y, 11M, 11C, and 11K are multiply transferred to an intermediate transfer belt 31, a second-transfer roller 41 that transfers the toner images having been transferred to and superposed one on top of another on the intermediate transfer belt 31 to the sheet P, and a fixing device 60 that fixes the toner images on the sheet P through application of heat and pressure thereto.

The optical unit 20 includes semiconductor lasers (not illustrated), a modulator (not illustrated), a polygonal mirror 21 that scanningly deflects the laser beams LB-Y, LB-M, LB-C, and LB-K emitted from the respective semiconductor lasers, glass windows 22 that transmit the laser beams LB-Y, LB-M, LB-C, and LB-K, and a rectangular-parallelpiped frame 23 in which components of the optical unit 20 are tightly sealed.

The intermediate transfer unit 30 includes the intermediate transfer belt 31, which is an exemplary image carrier as an intermediate transfer body, a driving roller 32 that rotates the intermediate transfer belt 31, and a tension roller 33 that gives a substantially constant tension to the intermediate transfer belt 31. The intermediate transfer unit 30 further includes plural (four in the general exemplary embodiment) first-transfer rollers 34 and a backup roller 35. The first-transfer rollers 34 are provided across the intermediate transfer belt 31 from the respective photoconductor drums 12 and transfer the toner images on the photoconductor drums 12 to the intermediate transfer belt 31. The backup roller 35 is provided across the intermediate transfer belt 31 from the second-transfer roller 41.

The intermediate transfer belt 31 is stretched with a substantially constant tension around the foregoing rotary members including the driving roller 32, the tension roller 33, the plural first-transfer rollers 34, and the backup roller 35 such that the length of the intermediate transfer belt 31 in a direction in which the plural first-transfer rollers 34 are arranged side by side is larger than the length of the intermediate transfer belt 31 in a direction that is substantially orthogonal to a plane containing the axes of rotation of the plural first-transfer rollers 34. The intermediate transfer belt 31 is rotated in a direction of the arrow at a predetermined speed by the driving roller 32 that is driven to rotate by a drive motor (not illustrated). The intermediate transfer belt 31 is molded from, for example, rubber or resin.

The intermediate transfer unit 30 further includes a cleaning device 36 that removes toner residues and the like remaining on the intermediate transfer belt 31. The cleaning device 36 includes a cleaning brush 36*a* and a cleaning blade 36*b* with which toner residues, paper lint, and the like are removed from the surface of the intermediate transfer belt 31 that has undergone the transfer of toner images.

As described above, in the intermediate transfer unit 30, the intermediate transfer belt 31 is stretched around the rotary members including the driving roller 32 and the tension roller 33 in such a manner as to have a long narrow shape in the direction in which the plural first-transfer rollers 34 are arranged side by side, with the backup roller 35 provided at one longitudinal end thereof and the cleaning device 36 provided at the other longitudinal end thereof.

The second-transfer roller 41 is pressed against the backup roller 35 with the intermediate transfer belt 31 interposed therebetween, whereby a second-transfer site is provided between the second-transfer roller 41 and the intermediate transfer belt 31. Toner images are second-transferred to a sheet P at the second-transfer site. To transfer toner images formed on the intermediate transfer belt 31 to a sheet P, the second-transfer roller 41 gives the sheet P a charge having a polarity opposite to a polarity with which the toners are charged, and transfers the toner images on the intermediate transfer belt 31 to the sheet P by utilizing an electrostatic force. Thus, a predetermined transfer electric field is produced between the second-transfer roller 41 and the backup roller 35.

The fixing device 60 fixes, with heat and pressure, the toner images on the sheet P that have been second-transferred to the sheet P by the intermediate transfer unit 30, the second-transfer roller 41, and so forth. The heat and pressure are applied by a heat roller 61, an endless belt 62, and so forth. The fixing device 60 will be described in detail separately below.

The sheet feeding section 170 includes a sheet container 171 that contains sheets P on each of which an image is to be recorded, a pickup roller 172 that picks up some of the sheets P from the sheet container 171 and feeds the sheets P into a transport path 174, and a feed roller 173 that separates each of the sheets P fed from the pickup roller 172 from the others and transports the sheet P. The sheet P separated from the others by the feed roller 173 is transported along the transport path 174 toward the second-transfer site. The sheet feeding section 170 further includes a registration roller 175 that transports the sheet P, having been transported from the transport path 174, toward the second-transfer site with an appropriate timing.

The sheet transport section 180 includes a pair of reversing rollers 181, a reversing transport unit 182, and a switching gate 183. The pair of reversing rollers 181 nip therebetween the sheet P discharged from the fixing device 60, transport the sheet P toward the stacking portion 177, and, according to need, switch back and reverse the sheet P. The reversing transport unit 182 transports the sheet P reversed by the pair of reversing rollers 181 toward the second-transfer site again. The switching gate 183 is provided between the fixing device 60 and the pair of reversing rollers 181 and switches the direction of transport of the sheet P.

The reversing transport unit 182 includes plural transport rollers with which the sheet P reversed by the pair of reversing rollers 181 is transported toward the second-transfer site again. The switching gate 183 switches the direction of transport of the sheet P discharged from the fixing device 60 between a direction toward the pair of reversing rollers 181 and a direction in which the sheet P reversed by the pair of reversing rollers 181 is guided into the reversing transport unit 182.

The image forming apparatus 1 configured as described above operates as follows.

An image on a piece of document that has been read by an image reading device (not illustrated) or an image data that has been received from a personal computer or the like (not illustrated) undergoes predetermined image processing operations. The image data thus processed is converted into four pieces of color tone data for yellow (Y), magenta (M), cyan (C), and black (K). The pieces of color tone data are output to the optical unit 20.

The optical unit 20 applies the laser beams LB-Y, LB-M, LB-C, and LB-K emitted from the semiconductor lasers (not illustrated) in accordance with the pieces of color tone data to the polygonal mirror 21 via an f-θ lens (not illustrated). The laser beams LB-Y, LB-M, LB-C, and LB-K applied to the polygonal mirror 21 are modulated in accordance with the respective pieces of color tone data, are scanningly deflected, and are applied to the photoconductor drums 12 of the respective image forming units 11Y, 11M, 11C, and 11K via an imaging lens and plural mirrors (both not illustrated).

The surfaces of the photoconductor drums 12 of the image forming units 11Y, 11M, 11C, and 11K that have been charged by the charging devices 13 are scanningly exposed to the laser beams LB-Y, LB-M, LB-C, and LB-K, respectively, whereby electrostatic latent images are formed on the photoconductor drums 12, respectively. The electrostatic latent images are developed into toner images in the colors of yellow (Y), magenta (M), cyan (C), and black (K) in the image forming units 11Y, 11M, 11C, and 11K, respectively. The toner images thus formed on the photoconductor drums 12 of the image forming units 11Y, 11M, 11C, and 11K are multiply transferred to the intermediate transfer belt 31, which is an intermediate transfer body.

Meanwhile, in the sheet feeding section 170, the pickup roller 172 rotates in accordance with the timing of image formation, and some of the sheets P in the sheet container 171 are picked up. One of the sheets P thus picked up is separated from the others by the feed roller 173, is transported along the transport path 174, and is temporarily stopped at the registration roller 175. Subsequently, the registration roller 175 rotates in accordance with the timing of rotation of the intermediate transfer belt 31 having the toner images, whereby the sheet P is transported to the second-transfer site defined between the backup roller 35 and the second-transfer roller 41. The toner images in the four respective colors that have been superposed one on top of another are transferred to the sheet P, which is transported from the lower side toward the upper side through the second-transfer site, in a sub-scanning direction with a certain pressure and a predetermined electric field. Subsequently, the sheet P having the toner images in the respective colors undergoes a fixing process performed by the fixing device 60 in which heat and pressure are applied to the sheet P. Then, the sheet P is discharged from the sheet transport section 180 and is stacked on the stacking portion 177, or is reversed and is transported to the second-transfer site again.

The fixing device 60 will now be described.

Figure 2:
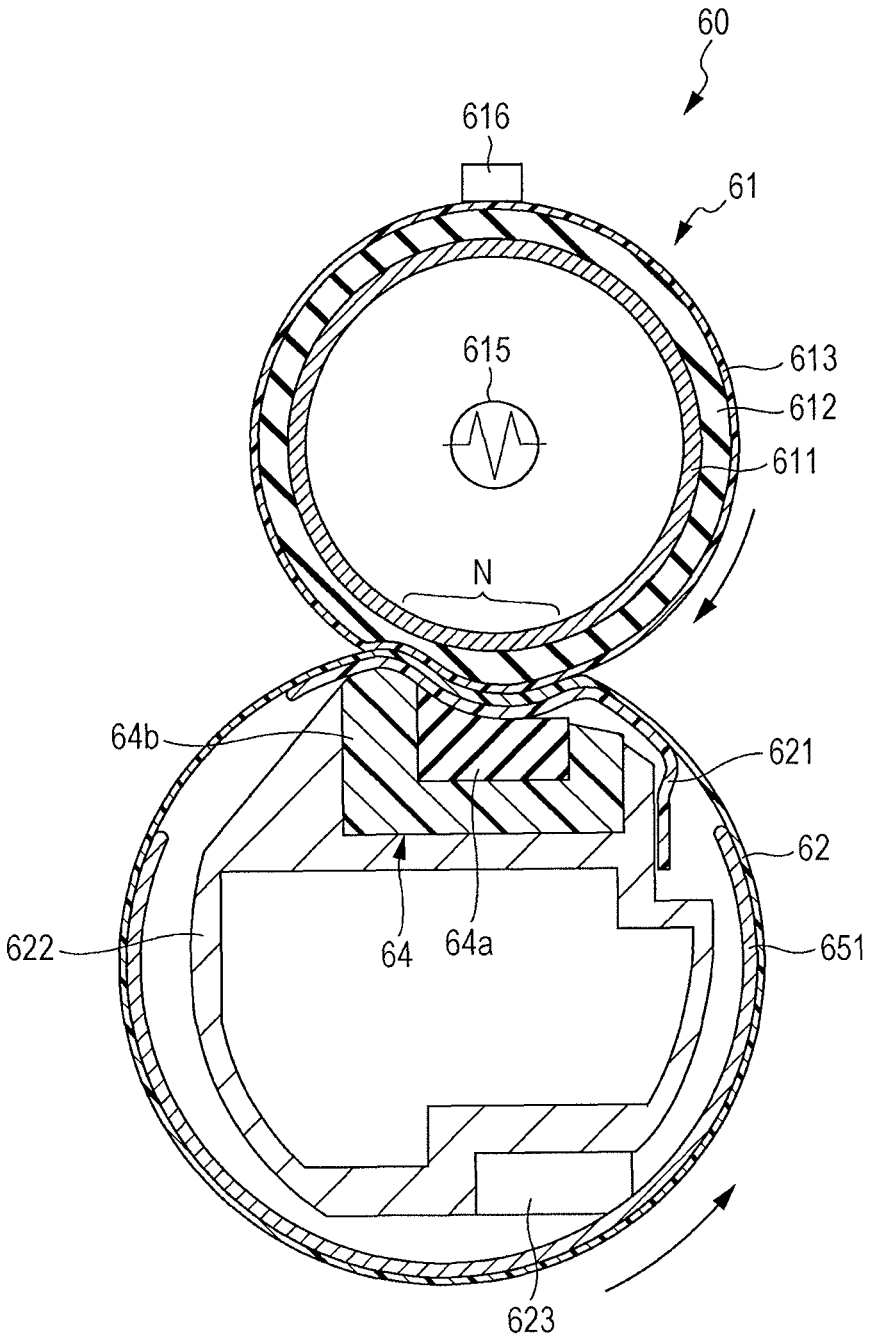
FIG. 2 is a vertical sectional view of a fixing device according to the general exemplary embodiment.

FIG. 2 is a vertical sectional view of the fixing device 60 according to the general exemplary embodiment.

The fixing device 60 includes the heat roller 61 as an exemplary heating member that heats the sheet P, and the endless belt (hereinafter also referred to as pressure belt) 62 as an exemplary pressing member that presses the heat roller 61 and as a part of the pressing member. The pressing member may alternatively be a pressure roller including a shaft as an exemplary rotating shaft and an elastic layer (for example, a rubber layer) provided around the shaft. The fixing device 60 functions as an embodiment of a heating device that heats the sheet P. In the following description, the endless belt 62 is described as an exemplary pressing member, as a part of the pressing member, and as an exemplary facing member that faces the heat roller 61. The endless belt 62 may be replaced with a pressure roller.

The heat roller 61 will first be described.

The heat roller 61 is a rotary member whose axis of rotation extends in a direction orthogonal to the page surface in FIG. 1 (a direction from one of the near side and the far side in FIG. 1 to the other). The heat roller 61 includes a thin-walled cylindrical or substantially cylindrical base member 611, a heat-resistant elastic layer 612 provided around the base member 611, and a release layer 613 provided over the heat-resistant elastic layer 612. The heat roller 61 is provided on a fixing-device frame 60*a* (see FIG. 3) that is fixed to or is detachably attached to a body frame (not illustrated) of the image forming apparatus 1. The heat roller 61 is rotatably supported at two axial ends thereof by the frame 60*a* (see FIG. 3) with bearing members (not illustrated), such as ball bearings, interposed therebetween. The axis of rotation may be either a shaft member that physically exists or a virtual axis that does not physically exists.

The base member 611 is a thin-walled cylindrical or substantially cylindrical body. The base member 611 is made of a material that elastically deforms when the heat roller 61 and the endless belt 62 come into contact with each other, and restores its original shape with its own stiffness when the heat roller 61 and the endless belt 62 go out of contact with each other. The material of the base member 611 also has a high thermal conductivity. Examples of such a material include iron, nickel, nickel copper, stainless-used steel (SUS), nickel-cobalt alloy, copper, gold, nickel-iron alloy, and the like. Since the base member 611 exhibits the above characteristics, the heat roller 61 elastically deforms at the contact with the endless belt 62. Consequently, the area of a nip part N, which is an area of contact between the heat roller 61 and the endless belt 62 extending in the direction of sheet transport, is increased. In this state, the heat roller 61 applies a pressure to the sheet P residing in the nip part N by utilizing its own elasticity and in combination with the endless belt 62. When the heat roller 61 goes out of contact with the endless belt 62, the heat roller 61 restores its original cylindrical or substantially cylindrical shape with its own stiffness. A portion of the base member 611 corresponding to the nip part N is not supported from the inner side (the inner side of the thin-walled cylindrical or substantially cylindrical shape) by any member. Since the base member 611 is made of a material that elastically deforms when the heat roller 61 and the endless belt 62 come into contact with each other and restores its original shape with its own stiffness when the heat roller 61 and the endless belt 62 go out of contact with each other, the base member 611 elastically deforms at the contact with the endless belt 62 and restores its cylindrical or substantially cylindrical shape with its own stiffness at the separation from the endless belt 62, although the portion of the base member 611 corresponding to the nip part N is not supported from the inner side by any member. According to need, however, a member supporting the portion of the base member 611 corresponding to the nip part N may be provided. The nip part N is an exemplary thermally pressed part where the heat roller 61 is pressed by a pressure pad 64 (to be described below) with the endless belt 62 interposed therebetween and the sheet P is thermally pressed between the heat roller 61 and the endless belt 62.

The base member 611 according to the general exemplary embodiment is made of nickel and has an outside diameter of 25 mm and a wall thickness of 0.1 mm. The outside diameter is not limited to 25 mm and may be 20 mm to 30 mm. The wall thickness is not limited to 0.1 mm and may be 0.05 mm to 0.2 mm. The base member 611, which is made of nickel and has a cylindrical or substantially cylindrical shape with a wall thickness of 0.1 mm, is molded by any method, for example, by electroforming, deep drawing, or the like.

The heat-resistant elastic layer 612 is molded from a highly heat-resistant elastic material. The material of the heat-resistant elastic layer 612 is arbitrary as long as the material has a high heat-resistance and elasticity. In particular, an elastic material such as rubber or elastomer having a hardness of about 5° to about 20° (JIS-A) may be employed. Specifically, silicone rubber, fluororubber, or the like may be employed.

The release layer 613 is molded from heat-resistant resin. Any heat-resistant resin is acceptable, for example, silicone resin, fluororesin, or the like may be employed. In particular, fluororesin is suitable in view of the releasability and wear resistance of the release layer 613 with respect to toners. Among various types of fluororesin, perfluoroalkoxy (PFA), polytetrafluoroethylene (PTFE), perfluoroethylene propylene copolymer (FEP), or the like may be employed. The release layer 613 may have a thickness of 5 μm to 30 μm.

The fixing device 60 includes a halogen heater 615 provided inside the heat roller 61 and functioning as a heat source, and a temperature sensor 616 that detects the temperature on the surface of the heat roller 61. The controller 190 controls whether to turn on the halogen heater 615 in accordance with the temperature detected by the temperature sensor 616 and maintains the surface temperature of the heat roller 61 at a predetermined fixing temperature (for example, 170° C.).

The endless belt 62 will now be described.

The endless belt 62 originally has a cylindrical shape with a diameter of 30 mm and includes a base layer and a release layer (both not illustrated). The release layer is provided on one side of the base layer nearer to the heat roller 61 or on both sides of the base layer. The base layer is made of polymer such as polyimide, polyamide, or polyimide-amide, or metal such as SUS, nickel, or copper, and may have a thickness of 30 μm to 200 μm. The release layer provided over the base layer is made of fluororesin such as PFA, PTFE, or FEP, and may have a thickness of 5 μm to 100 μm.

The inner circumferential surface of the endless belt 62 has a surface roughness Ra (arithmetic mean roughness) of 0.4 μm or smaller so that the rubbing resistance with respect to the pressure pad 64, to be described below, is reduced. The outer circumferential surface of the endless belt 62 has a surface roughness Ra of 1.2 μm to 2.0 μm so that the driving force from the heat roller 61 can be received sufficiently.

A configuration that supports the endless belt 62 will now be described.

The fixing device 60 includes the pressure pad 64 and an edge guide (not illustrated) that in combination support the endless belt 62 allowing the rotation of the endless belt 62, a low-friction sheet 621 that reduces the rubbing resistance between the inner circumferential surface of the endless belt 62 and the pressure pad 64, and a metal holder 622 that holds the pressure pad 64 and the low-friction sheet 621.

The pressure pad 64 is provided on the inner side of the endless belt 62 and is pressed against the heat roller 61 with the endless belt 62 interposed therebetween, whereby the nip part N is formed between the heat roller 61 and the endless belt 62. The pressure pad 64 includes a pre-nip member 64*a* and a releasing nip member 64*b*. The pre-nip member 64*a* functions to form the nip part N extending over a relatively large length in the direction of sheet transport (in a direction in which the endless belt 62 and the heat roller 61 rotate). The releasing nip member 64*b* functions to deform the heat roller 61. The pre-nip member 64*a* is provided at the entrance of the nip part N. The releasing nip member 64*b* is provided at the exit of the nip part N.

The pre-nip member 64*a* is an elastic body made of silicone rubber, fluororubber, or the like, or is a leaf spring or the like. The surface of the pre-nip member 64*a* nearer to the heat roller 61 has a concave shape substantially conforming to the outer circumferential surface of the heat roller 61.

The releasing nip member 64*b* is molded from heat-resistant resin such as polyphenylene sulfide (PPS), polyimide, polyester, polyamide, or the like, or metal such as iron, aluminum, SUS, or the like. The outer surface of the releasing nip member 64*b* at the nip part N forms a convex curve with a substantially constant radius of curvature.

The inner circumferential surface of the endless belt 62, excluding a portion corresponding to the nip part N and peripheral portions therearound, is supported on two axial sides thereof by the outer circumferential surfaces of belt rotation guides 651. Therefore, the endless belt 62 rotates along the outer circumferential surfaces of the belt rotation guides 651. The belt rotation guides 651 are made of a material having a small coefficient of static friction so as to allow the endless belt 62 to rotate smoothly, and having a low thermal conductivity so as not to absorb a large amount of heat from the endless belt 62. The width of the endless belt 62 is substantially the same as the distance between the inner surfaces of flanges (not illustrated) provided at two axial ends of the holder 622. The flanges limit the movement (walk) of the endless belt 62 in the axial direction. Thus, the movements of the endless belt 62 in the direction of rotation and in the axial direction are limited by the edge guide (not illustrated) and the flanges (not illustrated).

In the general exemplary embodiment, the heat roller 61 is pressed by the pressure pad 64 with the endless belt 62 interposed therebetween and with a total load of 50 N to 250 N (5.1 kgf to 25.5 kgf). Such a configuration allows the endless belt 62 to rotate by following the rotation of the heat roller 61.

The low-friction sheet 621 is provided over the surfaces of the pre-nip member 64*a* and the releasing nip member 64*b* that face the endless belt 62. The low-friction sheet 621 is molded from a material having a small coefficient of friction and high wear- and heat-resistance so as to reduce the rubbing resistance (frictional resistance) between the inner circumferential surface of the endless belt 62 and the pressure pad 64. A surface of the low-friction sheet 621 that faces the endless belt 62 has microscopic irregularities that allow a lubricant applied to the inner circumferential surface of the endless belt 62 to spread over a rubbing part defined between the low-friction sheet 621 and the endless belt 62. The irregularities correspond to a surface roughness Ra (arithmetic mean roughness) of 5 μm to 30 μm. If the irregularities correspond to a surface roughness Ra smaller than 5 μm, the lubricant is difficult to sufficiently spread over the rubbing part between the low-friction sheet 621 and the endless belt 62. If the irregularities correspond to a surface roughness Ra larger than 30 μm, the irregularities may appear as nonuniformity in gloss when an image is fixed on an overhead-projector (OHP) sheet or a piece of coated paper. The low-friction sheet 621 is less permeable to the lubricant so that the lubricant may not permeate through the low-friction sheet 621 and may not leak from the other side thereof. Specifically, the low-friction sheet 621 may be any of the following: a piece of porous-resin-fiber cloth made of fluororesin as a base layer whose side facing the pressure pad 64 is covered with a polyethylene-terephthalate (PET) sheet, a sintered PTFE sheet, a glass fiber sheet with Teflon (a registered trademark) impregnated, and the like. The low-friction sheet 621 may be provided as a separate body from the pre-nip member 64*a* and the releasing nip member 64*b* or as an integral body together with the pre-nip member 64*a* and the releasing nip member 64*b*.

The holder 622 holds the pressure pad 64, the low-friction sheet 621, and a lubricant applying member 623. The lubricant applying member 623 extends in the axial direction of the heat roller 61. The lubricant is applied to the inner circumferential surface of the endless belt 62 by the lubricant applying member 623. The lubricant applying member 623 is made of heat-resistant felt and is impregnated with about 3 grams of lubricant, such as amino-modified silicone oil, having a viscosity of 300 cs, for example. The lubricant applying member 623 is provided in contact with the inner circumferential surface of the endless belt 62 and supplies an appropriate amount of lubricant to the inner circumferential surface of the endless belt 62 with the osmotic pressure occurring through the heat-resistant felt. The edge of the heat-resistant felt forming the lubricant applying member 623 is in contact with the inner circumferential surface of the endless belt 62 such that an excessive amount of lubricant is not supplied to the endless belt 62 from the heat-resistant felt. Since the lubricant is supplied to the rubbing part between the endless belt 62 and the low-friction sheet 621 as described above, the rubbing resistance between the endless belt 62 and the pressure pad 64 via the low-friction sheet 621 is further reduced. Thus, smooth rotation of the endless belt 62 is realized.

The heat roller 61 of the fixing device 60 will now be described.

Figure 3:
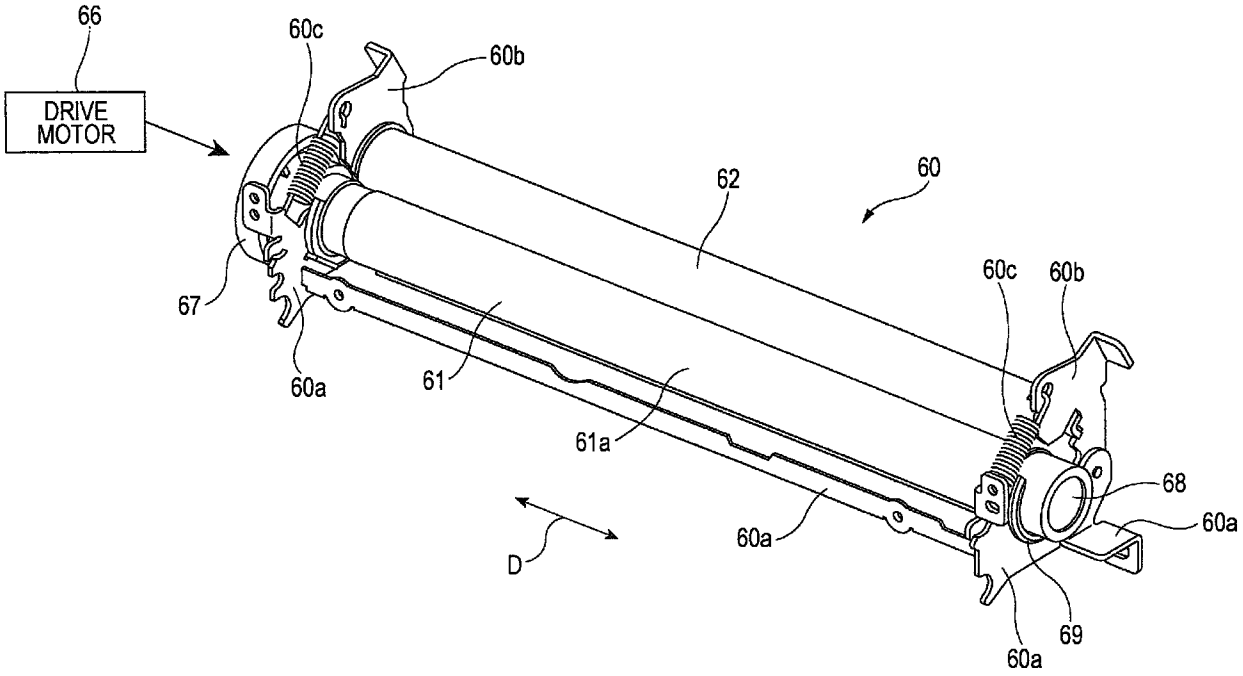
FIG. 3 illustrates a heat roller included in the fixing device.

FIG. 3 illustrates the heat roller 61.

As illustrated in FIG. 3, the fixing device 60 includes the frame 60*a*, the heat roller 61, and the endless belt 62, i.e., the pressure belt 62. The frame 60*a* is positioned with respect to and is provided on the image forming apparatus 1.

The heat roller 61 is rotatably provided on the frame 60*a*. The pressure belt 62 is provided on a supporting member 60*b* that is movable relative to the frame 60*a*. The frame 60*a* and the supporting member 60*b* are connected to each other with compression springs 60*c*. The compression springs 60*c* act such that the pressure belt 62 presses the heat roller 61.

The fixing device 60 further includes a drive motor 66 that outputs a driving force with which the heat roller 61 is driven, and a transmission member 67 that transmits the driving force from the drive motor 66 to the heat roller 61.

The drive motor 66 is controlled by the controller 190 (see FIG. 1). The transmission member 67 is attached to a cylindrical or substantially cylindrical member 61*a* (hereinafter simply referred to as cylindrical member 61*a*) as the base member 611. More specifically, the transmission member 67 is attached to one end, which is a driving-side end (the left end in FIG. 3), of the cylindrical member 61*a*.

The fixing device 60 further includes position regulating members 68 provided at two ends, respectively, of the cylindrical member 61*a* of the heat roller 61, and fixing sleeves 69 provided on the frame 60*a* and engaging with the position regulating members 68, respectively. The position regulating members 68 are made of PPS, for example. The fixing sleeves 69 are made of PPS or polyphthalamide (PPA), for example.

The position regulating members 68 and the fixing sleeves 69 are provided at the driving-side end (the left end in FIG. 3) and at the other end, which is a driven-side end (the right end in FIG. 3), of the cylindrical member 61*a*. The fixing sleeves 69 is fixed relative to the frame 60*a*.

The cylindrical member 61*a* of the heat roller 61 is held at the two ends thereof by the frame 60*a* with the position regulating members 68 and the fixing sleeves 69 interposed therebetween. The cylindrical member 61*a* and the position regulating members 68 are rotatable together. That is, when the heat roller 61 undergoes elastic deformation when pressed by the pressure belt 62, the cylindrical member 61*a* and the position regulating members 68 are rotatable in the same direction and at the same number of revolutions.

More specifically, when the driving force of the drive motor 66 is transmitted to one of the position regulating members 68 at the driving-side end (the left end in FIG. 3) via the transmission member 67, the cylindrical member 61*a* rotates by following the rotation of the position regulating member 68. When the cylindrical member 61*a* rotates by receiving the driving force of the drive motor 66, the other position regulating member 68 at the driven-side end (the right end in FIG. 3) rotates by following the rotation of the cylindrical member 61*a*.

Thus, in the fixing device 60, the cylindrical member 61*a* of the heat roller 61 rotates together with the position regulating members 68.

The image forming section 10 is an exemplary toner-image-forming section. The second-transfer roller 41 is an exemplary transfer section. The fixing device 60 is an exemplary fixing device and is an exemplary fixing section.

The pressure belt 62 as the endless belt 62 is an exemplary pressing member. The heat roller 61 is an exemplary heating member. The cylindrical member 61*a* as the base member 611 is an exemplary substantially cylindrical member. The halogen heater 615, which will also be referred to as heater 61*b*, is an exemplary heating unit.

A first exemplary embodiment of the present invention will now be described.

Figure 4:
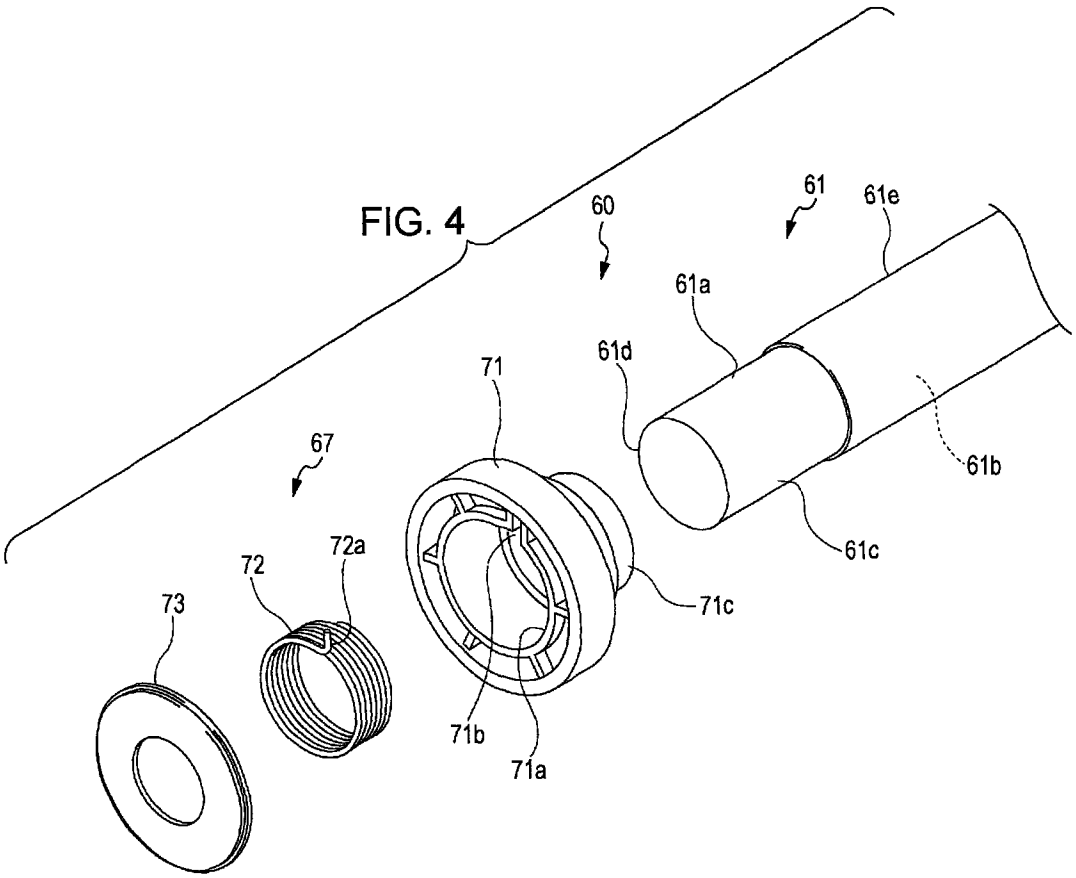
FIG. 4 illustrates relevant parts of a fixing device according to a first exemplary embodiment of the present invention.
Figure 5:
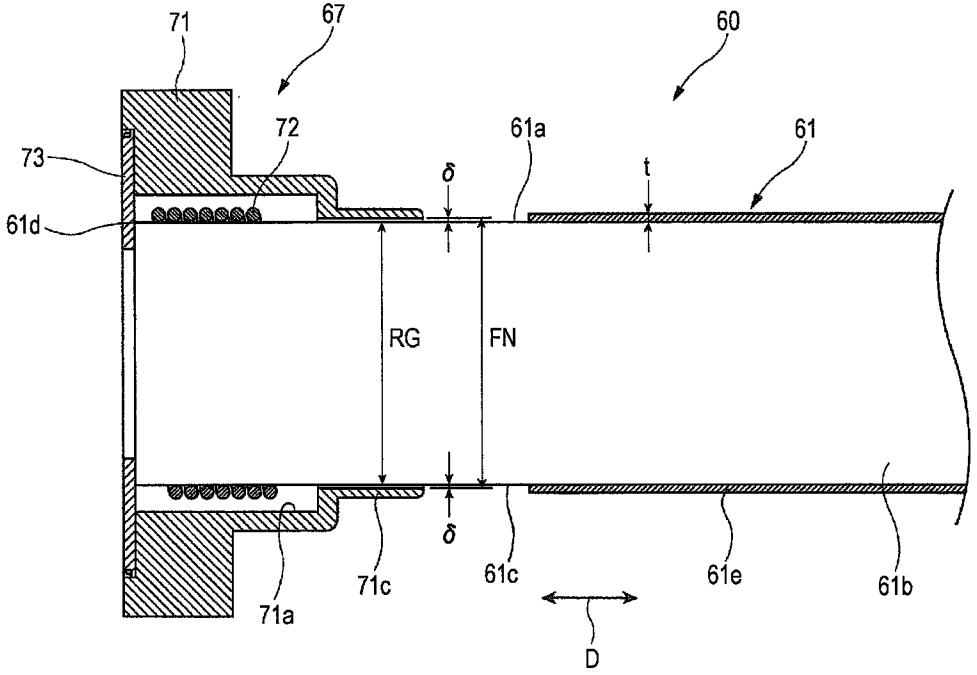
FIG. 5 also illustrates relevant parts of the fixing device according to the first exemplary embodiment.

FIGS. 4 and 5 illustrate relevant parts of the fixing device 60 according to the first exemplary embodiment. FIG. 4 is an exploded perspective view illustrating the driving-side end (the left end in FIG. 3) of the heat roller 61. FIG. 5 is a sectional view illustrating the driving-side end of the heat roller 61 when the heat roller 61 is not pressed. Specifically, FIG. 5 is a sectional view taken along line V-V illustrated in FIG. 6, to be referred to below.

Referring to FIGS. 4 and 5, the transmission member 67 according to the first exemplary embodiment includes a toothed driving gear 71 into which the driving force of the drive motor 66 (see FIG. 3) is input, and a transmission spring 72 as a helical torsion spring fitted on the cylindrical member 61*a* of the heat roller 61. The transmission spring 72 includes an arm 72*a* (see FIG. 4) projecting from one end thereof. The transmission spring 72 functions as a spring clutch in the transmission of the driving force to the cylindrical member 61*a*. Details of the transmission spring 72 will be described separately below.

The transmission member 67 further includes a lid member 73 that is fitted in the driving gear 71 and receives an end facet 61*d* of the cylindrical member 61*a*.

The driving gear 71 is an exemplary gear.

The driving gear 71 of the transmission member 67 includes a recess 71*a* in which the transmission spring 72 is fitted, and an engaging portion 71*b* (see FIG. 4) that receives the arm 72*a* of the transmission spring 72 fitted in the recess 71*a* and thus engages with the arm 72*a*.

The driving gear 71 further includes a flange portion 71*c* extending in the longitudinal direction of the cylindrical member 61*a*. The inside diameter of the flange portion 71*c* is larger than the outside diameter (outside roller diameter) of a bare portion 61*c*, to be described below, of the cylindrical member 61*a*. That is, a gap δ (see FIG. 5) is provided between the flange portion 71*c* and the bare portion 61*c*.

The lid member 73 of the transmission member 67 is fitted in the recess 71*a* of the driving gear 71 together with the transmission spring 72. The lid member 73 covers part of the recess 71*a* so as to prevent the transmission spring 72 fitted in the recess 71*a* from coming out of the recess 71*a*.

The end facet 61*d* of the cylindrical member 61*a* is in contact with the lid member 73, whereby the position of the heat roller 61 in a longitudinal direction D (see FIGS. 3 and 5) is determined.

The heat roller 61, including the cylindrical member 61*a* and the heater 61*b*, further includes a film 61*e* as a combination of the heat-resistant elastic layer 612 and the release layer 613. The film 61*e* is provided over a central portion of the cylindrical member 61*a*. In other words, the driving-side end (the left end in FIG. 3) and the driven-side end (the right end in FIG. 3) of the cylindrical member 61*a* are not covered with the film 61*e* and are bare. Such bare portions of the cylindrical member 61*a* are herein referred to as bare portions 61*c*.

The inside diameter of the transmission spring 72 of the transmission member 67 is substantially the same as the outside diameter (outside roller diameter) of a corresponding one of the bare portions 61*c* of the cylindrical member 61*a*. The transmission spring 72 is fitted on the cylindrical member 61*a* and resides on the bare portion 61*c*.

Now, how the pressing by the pressure belt 62 (see FIG. 3) acts on the cylindrical member 61*a* of the heat roller 61 will be described.

Figure 6:
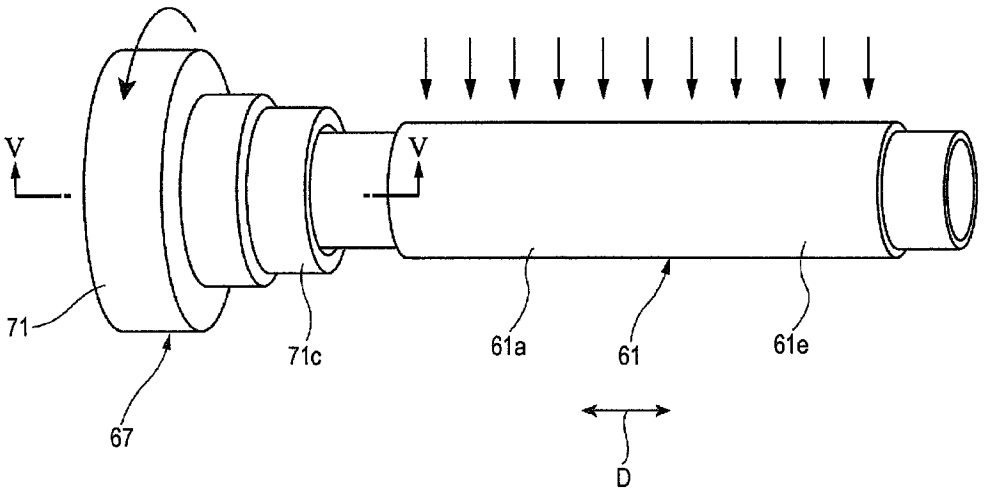
FIG. 6 illustrates how the heat roller behaves when pressed.
Figure 7B:
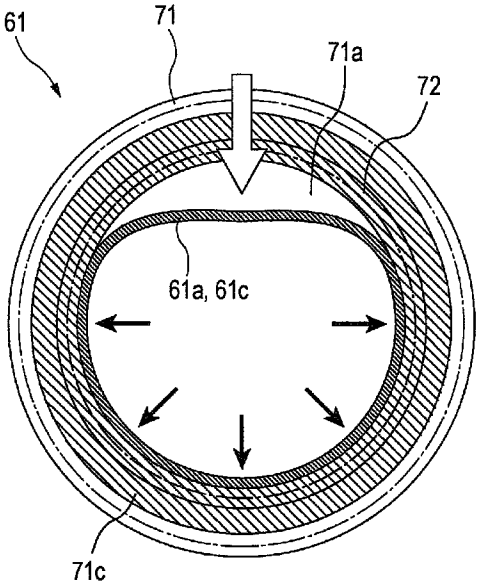
FIGS. 7A and 7B also illustrate how the heat roller behaves when pressed.
Figure 7A:
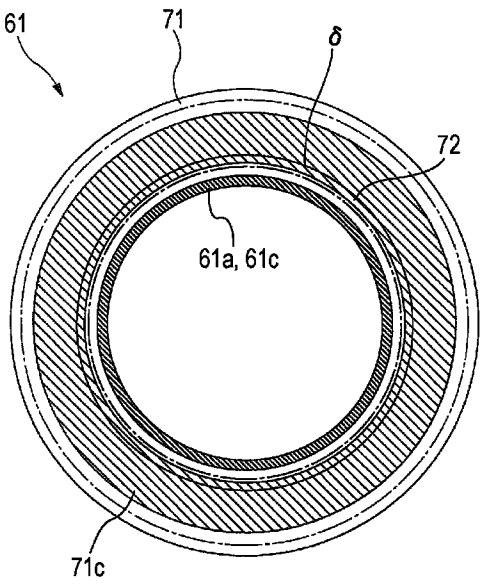
Figure 8:
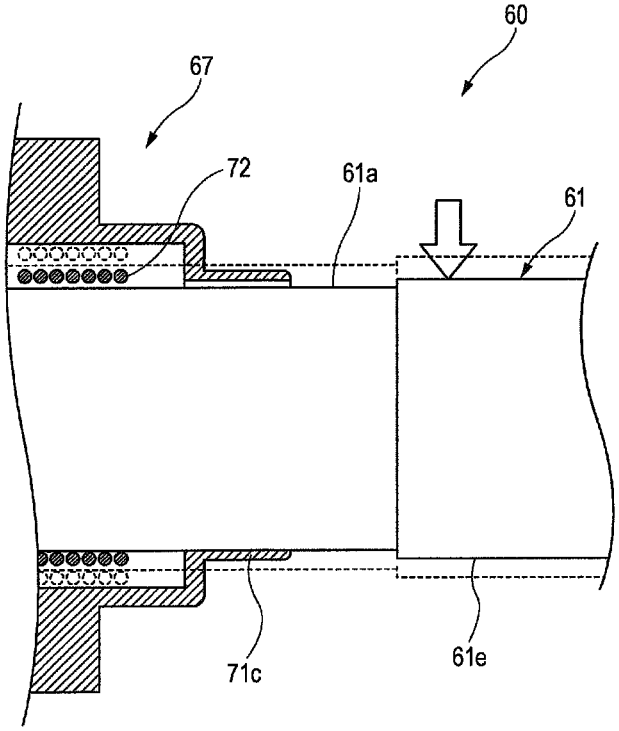
FIG. 8 also illustrates how the heat roller behaves when pressed.

FIGS. 6, 7A, 7B, and 8 illustrate how the heat roller 61 behaves when pressed. FIG. 6 is a perspective view of the heat roller 61 and the transmission member 67. FIGS. 7A and 7B are cross-sectional views of the cylindrical member 61*a* taken at an end thereof. FIG. 7A illustrates a state where the heat roller 61 is not pressed (under no load). FIG. 7B illustrates a state where the heat roller 61 is pressed (under a certain load). FIG. 8 illustrates how the heat roller 61 and the transmission spring 72 deform under a certain load.

As illustrated in FIG. 6, the cylindrical member 61*a* receives a pressure from the pressure belt 62 (see FIG. 3) in a central portion thereof. That is, the pressure belt 62 (see FIG. 3), which is rotatably supported by the frame 60*a*, provides a pressure acting in one direction with an urging force exerted by the compression springs 60*c*. Accordingly, the heat roller 61 is pressed by the pressure belt 62 (see FIG. 3) in the central portion of the cylindrical member 61*a*. Consequently, the cylindrical member 61*a*, which has a thin wall, deforms not only in the central portion but also in each of the bare portions 61*c*.

More specifically, when the cylindrical member 61*a* of the heat roller 61 is free of any pressure (nipping load) from the pressure belt 62, the cylindrical member 61*a* has a circular shape as illustrated in FIG. 7A, conforming to the inner circumferences of the position regulating members 68. In FIGS. 7A and 7B, the pitch circles of the teeth of the driving gear 71 are represented by dash-dotted lines.

As described above, the inside diameter of the transmission spring 72 and the outside diameter (outside roller diameter) of the bare portion 61*c* of the cylindrical member 61*a* are substantially the same. Furthermore, in the state illustrated in FIG. 7A (under no load), the gap δ (also illustrated in FIG. 5) is provided between the inner circumferential surface of the flange portion 71*c* of the driving gear 71 and the outer circumferential surface of the bare portion 61*c*.

When the cylindrical member 61*a* of the heat roller 61 receives a pressure (nipping load) from the pressure belt 62, the cylindrical member 61*a* deforms as illustrated in FIG. 7B. That is, when the pressure belt 62 presses the cylindrical member 61*a* of the heat roller 61, the cylindrical member 61*a* is squashed at some part thereof that has been pressed, whereas the other part of the cylindrical member 61*a* tends to swell (under a certain load).

More specifically, the cylindrical member 61*a*, which originally has a circular cross-sectional shape, swells in such a manner as to have a non-circular (substantially oval) cross-sectional shape. The part of the bare portion 61*c* of the cylindrical member 61*a* that has swelled presses, via a surface thereof having a certain size, the transmission spring 72 from the inner side toward the outer side, whereby the inside diameter of the transmission spring 72 is increased.

The bare portion 61*c*, which swells and widens the transmission spring 72 when under a certain load, is assumed to stop swelling when the stress applied to the transmission spring 72 from the bare portion 61*c* under the load balances out the spring force exerted by the transmission spring 72, as represented by the broken lines in FIG. 8. However, the bare portion 61*c* and the transmission spring 72 are prevented from swelling to that extent by the inner circumferential surface of the flange portion 71*c* of the driving gear 71, as represented by the solid lines in FIG. 8. Therefore, the bare portion 61*c* and the transmission spring 72 stop swelling when the bare portion 61*c* comes into contact with the inner circumferential surface of the flange portion 71*c*.

In other words, when under a certain load as illustrated in FIG. 7B, the outer circumferential surface of the bare portion 61*c* of the cylindrical member 61*a* that has swelled is partially in contact with the inner circumferential surface of the flange portion 71*c* such that the gap δ (illustrated in FIG. 5) between the outer circumferential surface of the bare portion 61*c* and the inner circumferential surface of the flange portion 71*c* is eliminated. That is, the bare portion 61*c* swells until the outer circumferential surface thereof partially comes into contact with the inner circumferential surface of the flange portion 71*c* of the driving gear 71. Once the bare portion 61*c* comes into contact with the inner circumferential surface of the flange portion 71*c* of the driving gear 71, the diameter of the bare portion 61*c* is no longer increased.

In the state illustrated in FIG. 7B (under a certain load), the inside diameter of the transmission spring 72 is substantially the same as the inside diameter of the flange portion 71*c*, and the outside diameter of the part of the bare portion 61*c* that is in contact with the inner circumferential surface of the flange portion 71*c* is substantially the same as the inside diameter of the flange portion 71*c*.

The deformation of the cylindrical member 61*a* caused by the pressing is observed over the entire length of the cylindrical member 61*a* in the longitudinal direction (thrust direction) D. Therefore, the cylindrical member 61*a* deforms both at the driving-side end (the left end in FIG. 3) thereof and at the driven-side end (the right end in FIG. 3) thereof.

The transmission spring 72 is housed in the driving gear 71 with the arm 72*a* (see FIG. 4) thereof engaging with the engaging portion 71*b* of the driving gear 71. The inside diameter of the transmission spring 72 is substantially the same as but is slightly larger than the outside diameter of the cylindrical member 61*a*.

When no driving force is input into the driving gear 71, a gap is provided between the transmission spring 72 and the outer circumferential surface of the bare portion 61*c* of the cylindrical member 61*a* of the heat roller 61. When a driving force is input into the driving gear 71, the inside diameter of the transmission spring 72 whose end is in engagement with the driving gear 71 is reduced and the transmission spring 72 comes into close contact with substantially the entire outer circumference of the bare portion 61*c* of the cylindrical member 61*a*. Hence, the driving force is assuredly transmitted from the driving gear 71 to the cylindrical member 61*a* without slipping, whereby the heat roller 61 rotates.

When the input of the driving force into the driving gear 71 is stopped, the inside diameter of the transmission spring 72 is increased and a gap is provided between the transmission spring 72 and the outer circumferential surface of the bare portion 61*c* of the cylindrical member 61*a*. That is, the transmission member 67 according to the first exemplary embodiment employs a spring clutch mechanism in which the cylindrical member 61*a* is rotated by using the transmission spring 72.

How the spring clutch mechanism works in the first exemplary embodiment will now be described.

Figure 9:
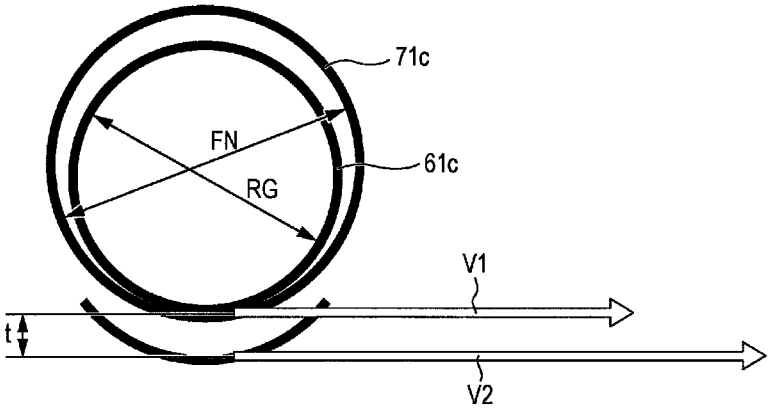
FIG. 9 illustrates the linear velocity of the heat roller in a driven state.

FIG. 9 illustrates the linear velocity of the heat roller 61 that is in a driven state.

In the state where the heat roller 61 has a circular cross-sectional shape under no load (see FIG. 7A), an outside diameter RG of the bare portion 61*c* of the cylindrical member 61*a* is substantially the same as the inside diameter of the transmission spring 72, as described above. Therefore, the heat roller 61 and the driving gear 71 rotate at the same number of revolutions with the driving force of the drive motor 66, and the speed at which the sheet P is transported is determined by the outside diameter of the cylindrical member 61*a*.

In the state where the heat roller 61 is under a certain load (see FIG. 7B), part of the bare portion 61*c* of the cylindrical member 61*a* deforms in such a manner as to conform to the inner circumference, defined by the inside diameter FN, of the flange portion 71*c* of the driving gear 71. Furthermore, the inside diameter of the transmission spring 72 becomes substantially equal to the inside diameter FN of the flange portion 71*c*. Therefore, the heat roller 61 and the driving gear 71 rotate at different numbers of revolutions with the driving force of the drive motor 66.

As described above, the heat roller 61 and the driving gear 71 rotate at different numbers of revolutions under a certain load. Such a transmission system that transmits the driving force of the drive motor 66 is provided as the transmission spring 72 whose inside diameter has been increased to the inside diameter FN of the flange portion 71*c*. Therefore, the speed at which the sheet P is transported is determined by the inside diameter FN of the flange portion 71*c* and a thickness t of the film 61*e* (see FIGS. 4, 5, and 6).

Specifically, a linear velocity V1 at the outer circumference of the bare portion 61*c* of the heat roller 61 is equal to the linear velocity at the inner circumference of the flange portion 71*c* and is obtained as the inside diameter FN of the flange portion 71*c* (also illustrated in FIG. 5) multiplied by the circle ratio $\pi$ and a speed of rotation v ($FN \times \pi \times v$). Furthermore, a linear velocity V2 at the outer circumference of the film 61*e* is obtained by adding the inside diameter FN of the flange portion 71*c* (also illustrated in FIG. 5) and double the thickness t of the film 61*e* (also illustrated in FIG. 5) and multiplying the result by the circle ratio $\pi$ and the speed of rotation v ($(FN+2t) \times \pi \times v$).

The linear velocity V1 at the outer circumference of the bare portion 61*c* and the linear velocity V2 at the outer circumference of the film 61*e* are not affected by the outside diameter RG of the bare portion 61*c*. Therefore, the outside diameter RG of the bare portion 61*c* does not need to be controlled. Accordingly, in the manufacturing process, the outside diameters of individual bare portions 61*c* do not need to be controlled.

In addition, the film 61*e* of the heat roller 61 is provided over the bare portion 61*c* by using a mold. Therefore, the outside diameters of individual films 61*e* are easier to control than to control the outside diameters of individual bare portions 61*c*.

A second exemplary embodiment of the present invention will now be described. The second exemplary embodiment employs elements and functions that are common to those of the first exemplary embodiment. Therefore, such elements and functions are denoted by reference numerals common to those used in the first exemplary embodiment, and description and illustration thereof are omitted according to need.

Figure 10:
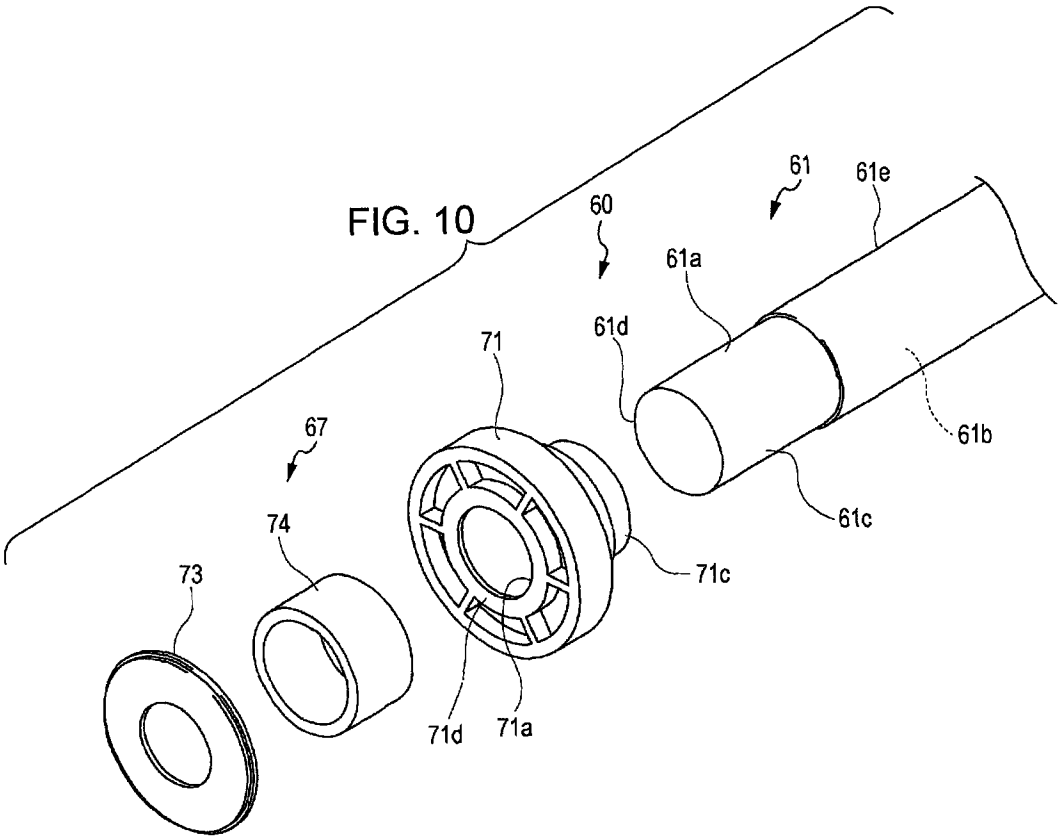
FIG. 10 illustrates relevant parts of a fixing device according to a second exemplary embodiment of the present invention.
Figure 11:
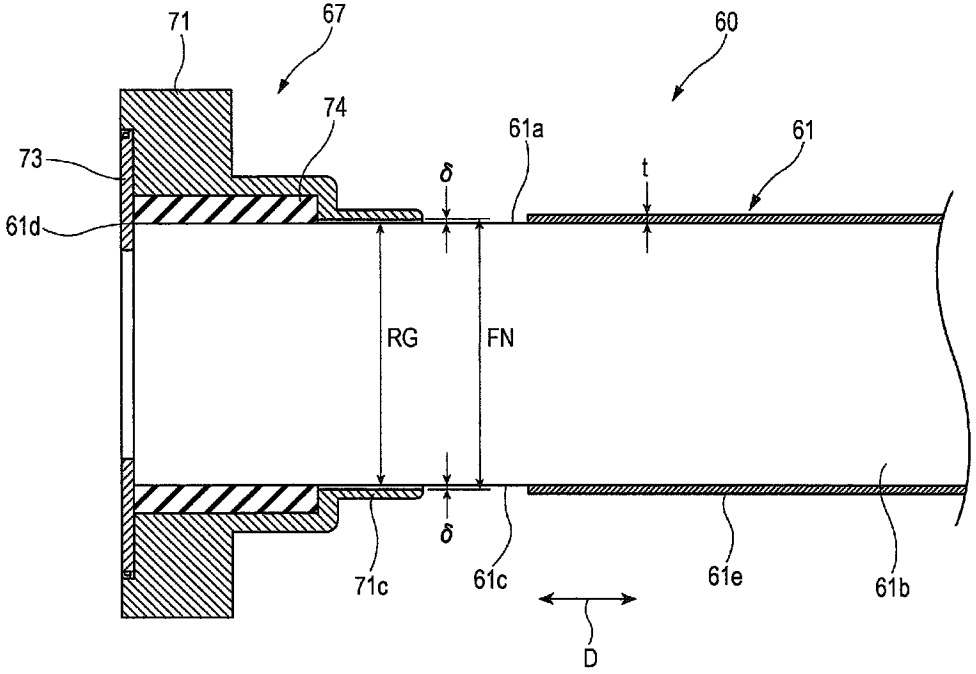
FIG. 11 also illustrates relevant parts of the fixing device according to the second exemplary embodiment.
Figure 12B:
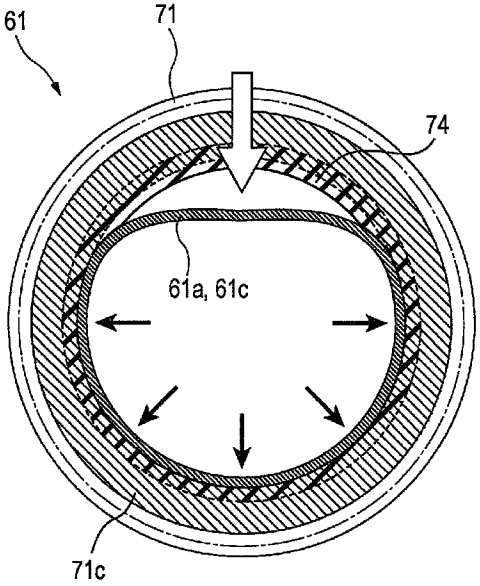
FIGS. 12A and 12B also illustrate relevant parts of the fixing device according to the second exemplary embodiment.
Figure 12A:
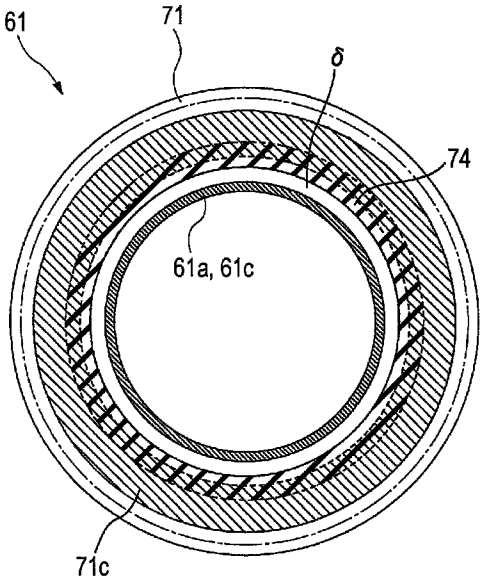

FIGS. 10, 11, 12A, and 12B illustrate relevant parts of the fixing device 60 according to the second exemplary embodiment. FIG. 10 is an exploded perspective view illustrating the driving-side end (the left end in FIG. 3) of the heat roller 61 and corresponds to FIG. 4 illustrating the first exemplary embodiment. FIG. 11 is a sectional view of the heat roller 61 that is not pressed and corresponds to FIG. 5 illustrating the first exemplary embodiment. FIGS. 12A and 12B illustrate how the heat roller 61 behaves when pressed and corresponds to FIGS. 7A and 7B illustrating the first exemplary embodiment.

In the second exemplary embodiment, as illustrated in FIGS. 10 and 11, the transmission member 67 includes a transmission rubber 74 that is fitted on the cylindrical member 61*a* of the heat roller 61 and is fitted in the recess 71*a* of the driving gear 71. The transmission rubber 74 is a substitute for the transmission spring 72 (see FIGS. 4 and 5) according to the first exemplary embodiment.

The transmission rubber 74 is fitted in the recess 71*a* with a high frictional force with respect to the driving gear 71.

That is, under no load as illustrated in FIG. 12A, a gap $\delta$ (also illustrated in FIG. 11) is provided between the inner circumferential surface of the flange portion 71*c* of the driving gear 71 and the outer circumferential surface of the cylindrical member 61*a*. Under a certain load as illustrated in FIG. 12B, part of the bare portion 61*c* of the cylindrical member 61*a* that has swelled is in contact with the inner circumferential surface of the flange portion 71*c* of the driving gear 71, whereby the outside diameter of the part of the bare portion 61*c* is determined. Furthermore, the part of the bare portion 61*c* of the cylindrical member 61*a* that has swelled is in close contact with the inner circumferential surface of the transmission rubber 74 via a surface thereof having a certain size, whereby the frictional force between the two is increased. Such rubber friction contributes to the transmission of the driving force from the driving gear 71 to the cylindrical member 61*a* via the transmission rubber 74.

A third exemplary embodiment of the present invention will now be described. The third exemplary embodiment employs elements and functions that are common to those of the first or second exemplary embodiment. Therefore, such elements and functions are denoted by reference numerals common to those used in the first or second exemplary embodiment, and description and illustration thereof are omitted according to need.

Figure 13:
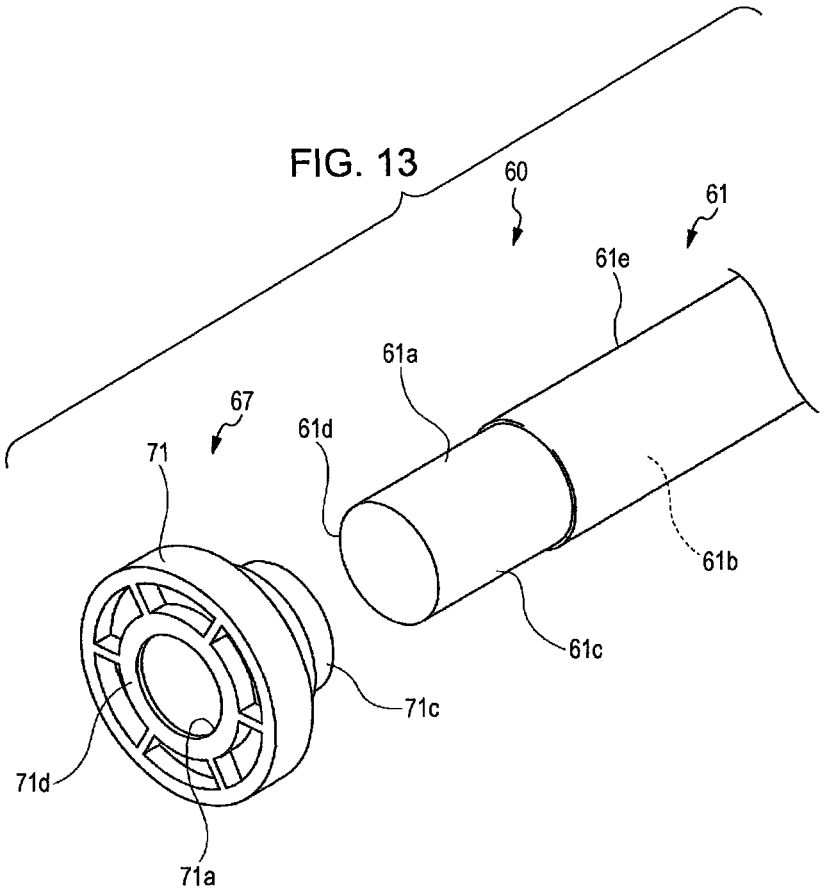
FIG. 13 illustrates relevant parts of a fixing device according to a third exemplary embodiment of the present invention.
Figure 14:
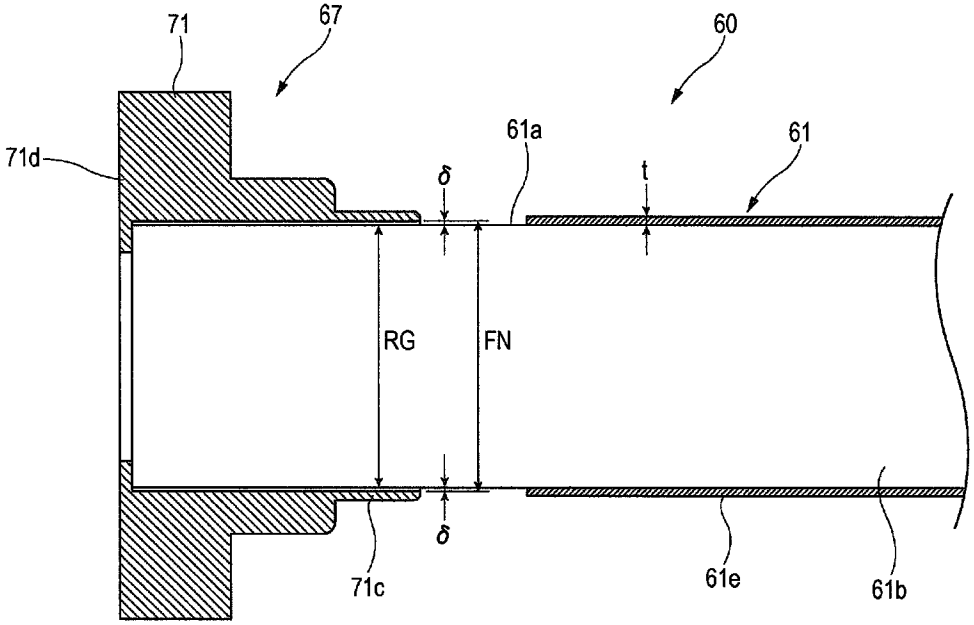
FIG. 14 also illustrates relevant parts of the fixing device according to the third exemplary embodiment.
Figure 15B:
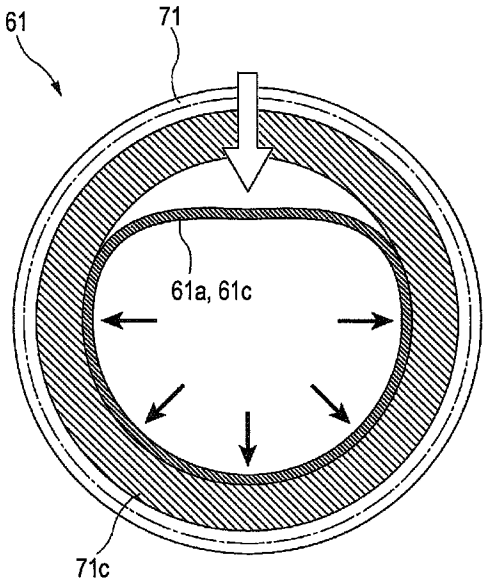
FIGS. 15A and 15B also illustrate relevant parts of the fixing device according to the third exemplary embodiment.
Figure 15A:
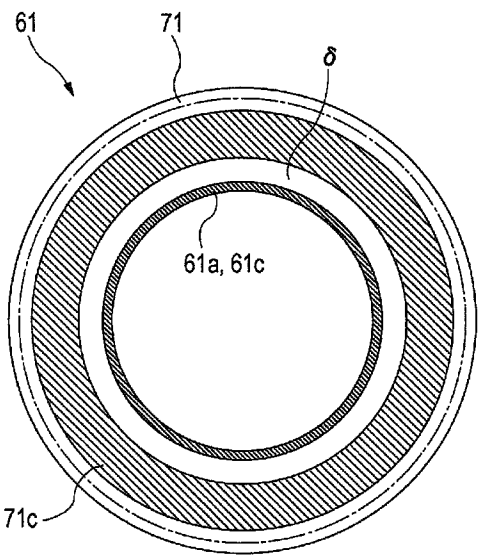

FIGS. 13, 14, 15A, and 15B illustrate relevant parts of the fixing device 60 according to the third exemplary embodiment. FIG. 13 is an exploded perspective view illustrating the driving-side end (the left end in FIG. 3) of the heat roller 61 and corresponds to FIG. 4 illustrating the first exemplary embodiment. FIG. 14 is a sectional view of the heat roller 61 that is not pressed and corresponds to FIG. 5 illustrating the first exemplary embodiment. FIGS. 15A and 15B illustrate how the heat roller 61 behaves when pressed and corresponds to FIGS. 7A and 7B illustrating the first exemplary embodiment.

In the third exemplary embodiment, as illustrated in FIGS. 13 and 14, the transmission member 67 includes the driving gear 71. That is, unlike the first and second exemplary embodiments, the transmission member 67 according to the third exemplary embodiment includes neither the transmission spring 72 nor the transmission rubber 74. Moreover, the transmission member 67 according to the third exemplary embodiment does not include the lid member 73.

In the transmission member 67 according to the third exemplary embodiment, the driving gear 71 of the transmission member 67 includes a receiving portion 71*d* instead of the lid member 73. The receiving portion 71*d* receives the end facet 61*d* of the cylindrical member 61*a* and thus determines the position of the heat roller 61 in the longitudinal direction D (see FIG. 3). Thus, the number of components included in the transmission member 67 is reduced.

More specifically, the driving gear 71 is a high-friction member made of a material having a high coefficient of friction. Therefore, as illustrated in FIG. 15B, part of the bare portion 61*c* that has swelled by being pressed by the pressure belt 62 is in surface contact with the inner circumferential surface of the flange portion 71*c* of the driving gear 71. Hence, the driving force that rotates the heat roller 61 is directly transmitted to the cylindrical member 61*a* with the aid of the frictional force produced by the surface contact. In this respect, the third exemplary embodiment differs from, for example, the first exemplary embodiment that employs the transmission spring 72 (see FIG. 5) via which the driving force is transmitted from the driving gear 71 to the cylindrical member 61*a*.

A fourth exemplary embodiment of the present invention will now be described. The fourth exemplary embodiment employs elements and functions that are common to those of the third exemplary embodiment. Therefore, such elements and functions are denoted by reference numerals common to those used in the third exemplary embodiment, and description and illustration thereof are omitted according to need.

Figure 16B:
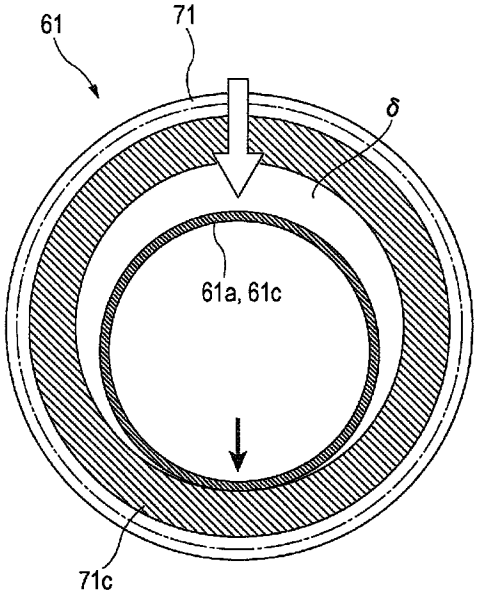
FIGS. 16A and 16B illustrate relevant parts of a fixing device according to a fourth exemplary embodiment of the present invention.
Figure 16A:
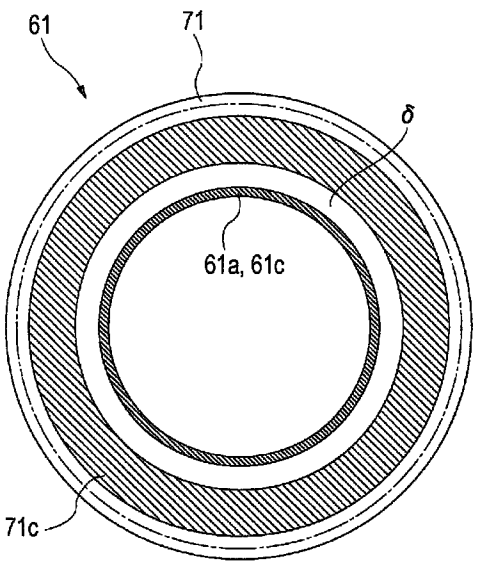

FIGS. 16A and 16B illustrate relevant parts of the fixing device 60 according to the fourth exemplary embodiment. FIGS. 16A and 16B illustrate how the heat roller 61 behaves when pressed and corresponds to FIGS. 15A and 15B illustrating the third exemplary embodiment.

The cylindrical member 61*a* of the heat roller 61 illustrated in FIGS. 16A and 16B is a high-friction member, as with the cylindrical member 61*a* according to the third exemplary embodiment, but is not deformable even under a pressure from the pressure belt 62, unlike the cylindrical member 61*a* according to the third exemplary embodiment (see FIGS. 15A and 15B). The bare portion 61*c* is pressed against the inner circumferential surface of the flange portion 71*c*. Such pressing causes the bare portion 61*c* to come into contact with the inner circumferential surface of the flange portion 71*c* of the driving gear 71. The driving force with which the heat roller 61 is rotated is directly transmitted to the cylindrical member 61*a* at the contact between the two. In the fourth exemplary embodiment, although the area of contact is not as large as that provided in the third exemplary embodiment (see FIGS. 15A and 15B), a frictional force sufficient for transmitting the driving force is provided.

In any of the first to fourth exemplary embodiments, the bare portion 61*c* of the heat roller 61 is brought into contact with the flange portion 71*c* of the driving gear 71 included in the transmission member 67. Therefore, the outside roller diameter of the bare portion 61*c* is determined by the inside diameter of the flange portion 71*c* that is easy to manufacture with high accuracy, and the accuracy of rotation is determined by the flange portion 71*c*. That is, in a state where a sheet P is nipped at the fixing device 60, when the flange portion 71*c* of the driving gear 71 undergoes one revolution, the sheet P advances by a length corresponding to the inner circumference of the flange portion 71*c*, regardless of the outer circumference of the bare portion 61*c*. Hence, the outside diameters of individual bare portions 61*c* of different cylindrical members 61*a* do not need to be controlled.

The first to fourth exemplary embodiments may be combined in any way, so that various modifications may be provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a pressing member that is rotatably held and provides a pressure acting in one direction;

a heating member that is rotatably held in such a manner as to face the pressing member and includes a substantially cylindrical member and a heating unit, the substantially cylindrical member receiving the pressure, the heating unit being provided inside the substantially cylindrical member, the heating member fixing a toner image on a sheet with the pressure provided by the pressing member and heat generated by the heating unit;

a drive source that outputs a driving force with which the heating member is rotated; and a transmission member that provides a space that receives an end of the substantially cylindrical member, the transmission member having an inner circumferential surface that is separated from an outer surface of the end of the substantially cylindrical member by an air gap when not receiving pressure from the pressing member, but which is configured to come into contact with the end of the substantially cylindrical member by closing the air gap in response to the substantially cylindrical member receiving the pressure from the pressing member, the transmission member transmitting the driving force of the drive source to the heating member, wherein when the air gap is closed, the transmission member and the substantially cylindrical member rotate at a different number of revolutions per unit time, wherein the heating member further includes a film provided over an outer circumferential surface of the substantially cylindrical member excluding a portion at the end of the substantially cylindrical member, the film coming into contact with the pressing member, and wherein the inner circumferential surface of the transmission member comes into contact with the end of the substantially cylindrical member that is free of the film.

2. A fixing device comprising:

a pressing member that is rotatably held and provides a pressure acting in one direction;

a heating member that is rotatably held in such a manner as to face the pressing member and includes a substantially cylindrical member and a heating unit, the substantially cylindrical member receiving the pressure, the heating unit being provided inside the substantially cylindrical member, the heating member fixing a toner image on a sheet with the pressure provided by the pressing member and heat generated by the heating unit;

a drive source that outputs a driving force with which the heating member is rotated; and a transmission member that provides a space that receives an end of the substantially cylindrical member, the transmission member having an inner circumferential surface that is separated from an outer surface of the end of the substantially cylindrical member by an air gap when not receiving pressure from the pressing member, but which is configured to come into contact with the end of the substantially cylindrical member by closing the air gap in response to the substantially cylindrical member receiving the pressure from the pressing member, the transmission member transmitting the driving force of the drive source to the heating member, wherein when the air gap is closed, the transmission member and the substantially cylindrical member rotate at a different number of revolutions per unit time, wherein, when receiving the pressure from the pressing member, the substantially cylindrical member deforms such that the end thereof partially swells, and wherein, the inner circumferential surface of the transmission member regulates an outside diameter of the end of the substantially cylindrical member that partially swells with the pressure from the pressing member.

3. The fixing device according to claim 2, wherein the transmission member includes a gear into which the driving force from the drive source is input; and a coil spring that engages with the gear and is fitted on the end of the substantially cylindrical member, a diameter of the coil spring being increased when the end of the substantially cylindrical member is deformed by receiving the pressure from the pressing member, wherein the driving force from the drive source is transmitted to the heating member with a rotation of the coil spring.

4. An image forming apparatus comprising:

a toner-image-forming section that forms a toner image;

a transfer section that transfers the toner image to a recording material; and a fixing section that fixes the toner image on the recording material, wherein the fixing section includes a pressing member that is rotatably held and provides a pressure acting in one direction;

a heating member that is rotatably held in such a manner as to face the pressing member and includes a substantially cylindrical member and a heating unit, the substantially cylindrical member receiving the pressure, the heating unit being provided inside the substantially cylindrical member, the heating member fixing a toner image on a sheet with the pressure provided by the pressing member and heat generated by the heating unit;

a drive source that outputs a driving force with which the heating member is rotated; and a transmission member that provides a space that receives an end of the substantially cylindrical member, the transmission member having an inner circumferential surface that is separated from an outer surface of the end of the substantially cylindrical member by an air gap when not receiving pressure from the pressing member, but which is configured to come into contact with the end of the substantially cylindrical member by closing the air gap in response to the substantially cylindrical member receiving the pressure from the pressing member, the transmission member transmitting the driving force of the drive source to the heating member, wherein when the air gap is closed, the transmission member and the substantially cylindrical member rotate at a different number of revolutions per unit time, wherein the heating member further includes a film provided over an outer circumferential surface of the substantially cylindrical member excluding a portion at the end of the substantially cylindrical member, the film coming into contact with the pressing member, and wherein the inner circumferential surface of the transmission member comes into contact with the end of the substantially cylindrical member that is free of the film.

5. An image forming apparatus comprising:

a toner-image-forming section that forms a toner image;

a transfer section that transfers the toner image to a recording material; and a fixing section that fixes the toner image on the recording material, wherein the fixing section includes a pressing member that is rotatably held and provides a pressure acting in one direction;

a heating member that is rotatably held in such a manner as to face the pressing member and includes a substantially cylindrical member and a heating unit, the substantially cylindrical member receiving the pressure, the heating unit being provided inside the substantially cylindrical member, the heating member fixing a toner image on a sheet with the pressure provided by the pressing member and heat generated by the heating unit;

a drive source that outputs a driving force with which the heating member is rotated; and a transmission member that provides a space that receives an end of the substantially cylindrical member, the transmission member having an inner circumferential surface that is separated from an outer surface of the end of the substantially cylindrical member by an air gap when not receiving pressure from the pressing member, but which is configured to come into contact with the end of the substantially cylindrical member by closing the air gap in response to the substantially cylindrical member receiving the pressure from the pressing member, the transmission member transmitting the driving force of the drive source to the heating member, wherein when the air gap is closed, the transmission member and the substantially cylindrical member rotate at a different number of revolutions per unit time, wherein, when receiving the pressure from the pressing member, the substantially cylindrical member deforms such that the end thereof partially swells, and wherein, the inner circumferential surface of the transmission member regulates an outside diameter of the end of the substantially cylindrical member that partially swells with the pressure from the pressing member.

6. The fixing device according to claim 5, wherein the transmission member includes a gear into which the driving force from the drive source is input; and a coil spring that engages with the gear and is fitted on the end of the substantially cylindrical member, a diameter of the coil spring being increased when the end of the substantially cylindrical member is deformed by receiving the pressure from the pressing member, wherein the driving force from the drive source is transmitted to the heating member with a rotation of the coil spring.

* * * * *